US011498187B2

(12) United States Patent
Huang et al.

(10) Patent No.: US 11,498,187 B2
(45) Date of Patent: Nov. 15, 2022

(54) CLAMPING DEVICE

(71) Applicant: PEGATRON CORPORATION, Taipei (TW)

(72) Inventors: Tsu-Hsuan Huang, Taipei (TW); Chun-Liang Yeh, Taipei (TW); Kuo-Jung Hsu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/945,516

(22) Filed: Jul. 31, 2020

(65) Prior Publication Data

US 2021/0060734 A1 Mar. 4, 2021

(30) Foreign Application Priority Data

Aug. 29, 2019 (TW) ..... 108130960

(51) Int. Cl.

| | |
|---|---|
| ***B25B 5/16*** | (2006.01) |
| ***B25B 5/04*** | (2006.01) |
| ***B25B 5/06*** | (2006.01) |
| ***B25B 5/14*** | (2006.01) |

(52) U.S. Cl.

CPC ..... *B25B 5/163* (2013.01); *B25B 5/04* (2013.01); *B25B 5/06* (2013.01); *B25B 5/147* (2013.01); *B25B 5/16* (2013.01)

(58) Field of Classification Search

CPC ..... F16B 2/10; B25B 5/04; B25B 5/14; B25B 5/147; B25B 5/163; B25B 5/06; B25B 5/16; F16M 13/022

See application file for complete search history.

(56) References Cited

U.S. PATENT DOCUMENTS

| | | | | |
|---|---|---|---|---|
| 5,381,989 | A * | 1/1995 | Jackson | B25B 5/06 248/231.51 |
| 2011/0162173 | A1* | 7/2011 | Ciminski | F16B 2/10 16/421 |
| 2017/0216997 | A1* | 8/2017 | Smith | B25B 5/16 |
| 2018/0010622 | A1* | 1/2018 | Wu | A47B 97/00 |
| 2018/0071895 | A1 | 3/2018 | Smith | |
| 2018/0326566 | A1* | 11/2018 | Dombek | B25B 5/147 |

FOREIGN PATENT DOCUMENTS

| | | |
|---|---|---|
| CN | 202629418 | 12/2012 |
| TW | M527841 | 9/2016 |

* cited by examiner

*Primary Examiner* — Mahdi H Nejad
(74) *Attorney, Agent, or Firm* — J.C. Patents

(57) ABSTRACT

A clamping device includes first and second clamping components and at least one elastic component. The first clamping component includes a first clamping portion and two first pivot portions connected to the first clamping portion. The second clamping component includes a second clamping portion and two second pivot portions connected to the second clamping portion. The second pivot portions are pivotally connected to the first pivot portions respectively, such that the first and second clamping components are capable of rotating relative to each other to present a first state and a second state. The elastic component is connected to the first clamping component and the second clamping component. When the first and second clamping components are in the second state, the elastic component provides an elastic force for the first clamping portion and the second clamping portion to be restored to the first state to clamp an object.

7 Claims, 8 Drawing Sheets

CLAMPING DEVICE

CROSS-REFERENCE TO RELATED APPLICATION

This application claims the priority benefit of Taiwan application serial no. 108130960, filed on Aug. 29, 2019. The entirety of the above-mentioned patent application is hereby incorporated by reference herein and made a part of this specification.

BACKGROUND

Technical Field

The disclosure provides a clamping device, and in particular, to a clamping device for clamping a cylinder.

Description of Related Art

Benefited from the development of automation manufacturing technology, various kinds of computer numerical control (CNC) tool machines are widely applied in the manufacturing industry. Some of the CNC tool machines are equipped with warning light cylinders, and a warning light cylinder may be used to emit a warning light when a CNC tool machine operates abnormally. Nevertheless, after the warning light cylinder emits a warning light, an operator needs to manually stop operation of the tool machine or operates on the machine tool to eliminate abnormalities, and the need for manual interference is not compliant with the concept of automation manufacturing. If a light sensor may be securely installed on the warning light cylinder, as the light sensor is configured to detect a warning light, automation of a tool machine is thereby be improved.

SUMMARY

The disclosure provides a clamping device configured for securely clamp an object.

A clamping device provided by the disclosure includes a first clamping component, a second clamping component, and at least one elastic component. The first clamping component includes a first clamping portion and two first pivot portions, and the first clamping portion is connected to the two first pivot portions. The second clamping component includes a second clamping portion and two second pivot portions, and the second clamping portion is connected to the two second pivot portions. The two second pivot portions are pivotally connected to the two first pivot portions respectively, such that the first clamping component and the second clamping component are capable of rotating relative to each other to present a first state and a second state. The elastic component is connected to the first clamping component and the second clamping component. When the first clamping component and the second clamping component are in the second state, the elastic component provides an elastic force for the first clamping portion and the second clamping portion to be restored to the first state to clamp an object.

In an embodiment of the disclosure, each of the second pivot portions is pivotally connected to the corresponding first pivot portion along a rotation axis, and the first clamping portion and the second clamping portion are located between the two first pivot portions and are located between the two second pivot portions in a direction parallel to the rotation axis.

In an embodiment of the disclosure, each of the second pivot portions is pivotally connected to the corresponding first pivot portion along a rotation axis, and the first clamping component intersects with the second clamping component in a direction parallel to the rotation axis.

In an embodiment of the disclosure, the first clamping portion includes at least one first arc structure, and the second clamping portion includes at least one second arc structure.

In an embodiment of the disclosure, each of the second pivot portions is pivotally connected to the corresponding first pivot portion along a rotation axis. A center of curvature of the at least one first arc structure and the rotation axis are located at a same side of the at least one first arc structure, and a center of curvature of the at least one second arc structure and the rotation axis are located at a same side of the at least one second arc structure.

In an embodiment of the disclosure, a number of the at least one elastic component is two. One of the elastic components is connected between one of the first pivot portions and the corresponding second pivot portion, and the other one of the elastic components is connected between the other one of the first pivot portions and the corresponding second pivot portion.

In an embodiment of the disclosure, the first clamping component includes a first tongue piece, the second clamping component includes a second tongue piece, and the first tongue piece and the second tongue piece are adapted to be applied by a force to drive the first clamping component and the second clamping component to rotate relative to each other to the second state.

In an embodiment of the disclosure, the first tongue piece and the second tongue piece are respectively located on the first clamping portion and the second clamping portion.

In an embodiment of the disclosure, the clamping device includes at least one first anti-skid component and at least one second anti-skid component. The at least one first anti-skid component is sleeved on the first clamping portion, and the at least one second anti-skid component is sleeved on the second clamping portion.

To sum up, in the clamping device provided by the disclosure, the first clamping component and the second clamping component are connected through the at least one elastic component. Further, the first clamping portion connected between the two first pivot portions and the second clamping portion connected between the two second pivot portions are used to for clamping. In this way, an object (e.g., a cylinder) is surrounded by the first clamping component and the second clamping component between the pivot portions and thus is securely clamped.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
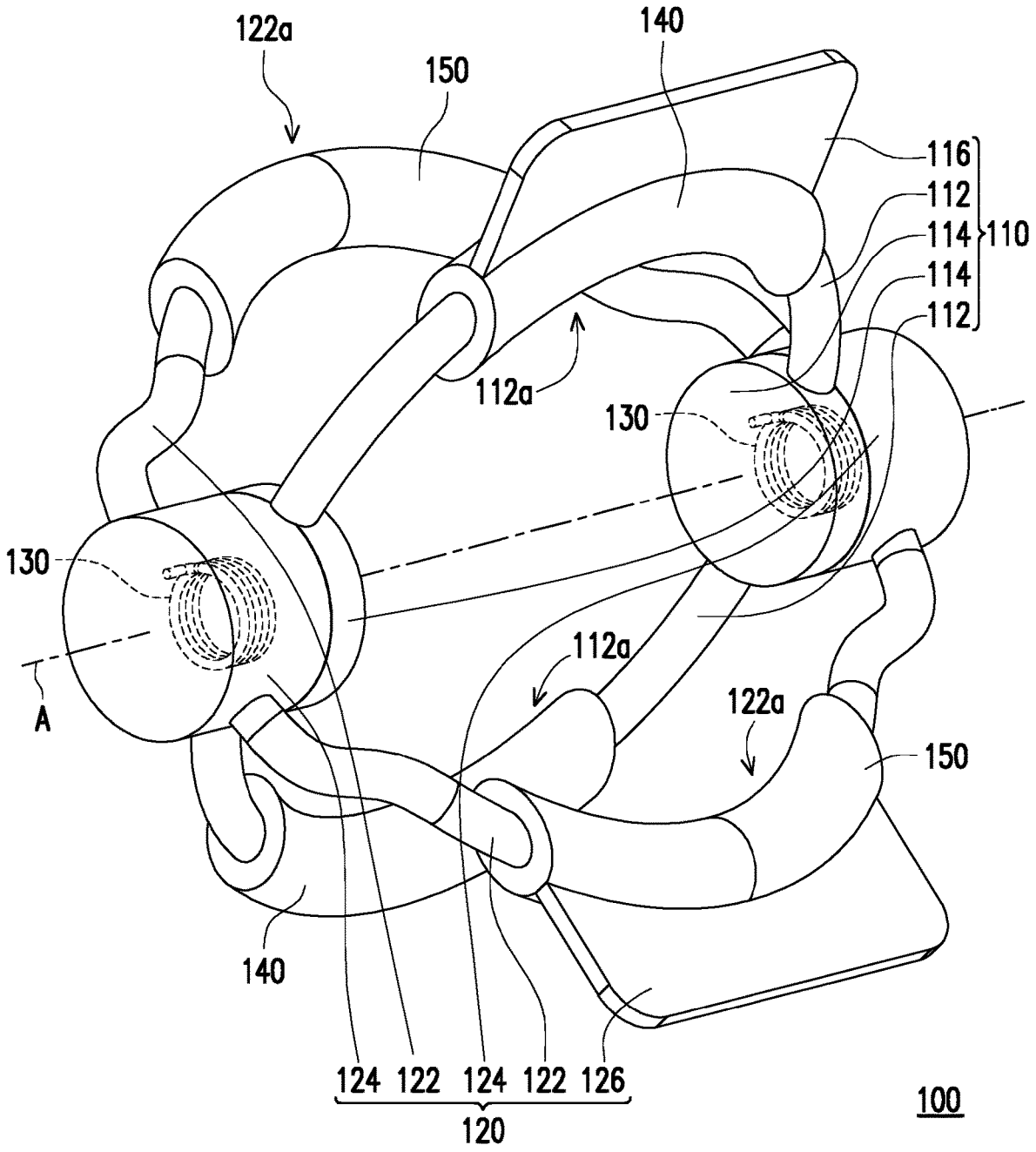
FIG. 1 is a stereo view of a clamping device according to an embodiment of the disclosure.

FIG. 1 is a stereo view of a clamping device according to an embodiment of the disclosure. With reference to FIG. 1, a clamping device 100 of this embodiment includes a first clamping component 110, a second clamping component 120, and at least one elastic component 130. The first clamping component 110 includes a first clamping portion 112 and two first pivot portions 114. The first clamping portion 112 is connected to the two first pivot portions 114. The second clamping component 120 includes a second clamping portion 122 and two second pivot portions 124. The second clamping portion 122 is connected to two second pivot portions 124, and the two second pivot portions 124 are respectively pivotally connected to the two first pivot portions 114 along a rotation axis A. The at least one elastic component 130 is connected to the first clamping component 110 and the second clamping component 120.

In this embodiment, a number of the at least one elastic component 130 is two, and the two elastic components 130 are, for example, springs. One of the elastic components 130 is connected between one of the first pivot portions 114 and the corresponding second pivot portion 124, and the other one of the elastic components 130 is connected between the other one of the first pivot portions 114 and the corresponding second pivot portion 124. Specifically, one end of each of the elastic components 130 may abut against an appropriate abutting surface in the corresponding first pivot portion 114 or may be secured to a structure in the corresponding first pivot portion 114 through an appropriate manner. Further, the other end of each of the elastic components 130 may abut against an appropriate abutting surface in the corresponding second pivot portion 124 or may be secured to a structure in the corresponding second pivot portion 124 through another appropriate manner. Alternatively, the first clamping portion 112 may be inserted in the first pivot portions 114, and the second clamping portion 122 may be inserted in the second pivot portions 124. In this way, one end of each of the elastic components 130 may abut against an appropriate abutting surface of the first clamping portion 112 in the corresponding first pivot portion 114 or may be secured to a structure of the first clamping portion 112 in the corresponding first pivot portion 114 through another appropriate manner. Further, one end of each of the elastic components 130 may abut against an appropriate abutting surface of the second clamping portion 122 in the corresponding second pivot portion 124 or may be secured to a structure of the second clamping portion 122 in the corresponding second pivot portion 124 through another appropriate manner. How the elastic components 130 are connected is not limited by the disclosure.

More specifically, the first clamping component 110 and the second clamping component 120 are X-shaped when being viewed from a direction parallel to the rotation axis A. That is, the first clamping component 110 intersects with the second clamping component 120 in the direction parallel to the rotation axis A. Moreover, the first clamping portion 112 and the second clamping portion 122 are located between the two first pivot portions 114 and are located between the two second pivot portions 124 in the direction parallel to the rotation axis A.

The first clamping component 110 and the second clamping component 120 are adapted to rotate relative to each other through elastic forces of the elastic components 130 and are adapted to resist the elastic forces of the elastic components 130 to rotate relative to each other, such that a distance between the first clamping portion 112 and the second clamping portion 122 is changed. In this way, an object (e.g., a cylinder) may pass through and be clamped between the first clamping portion 112 and the second clamping portion 122.

Figure 2A:
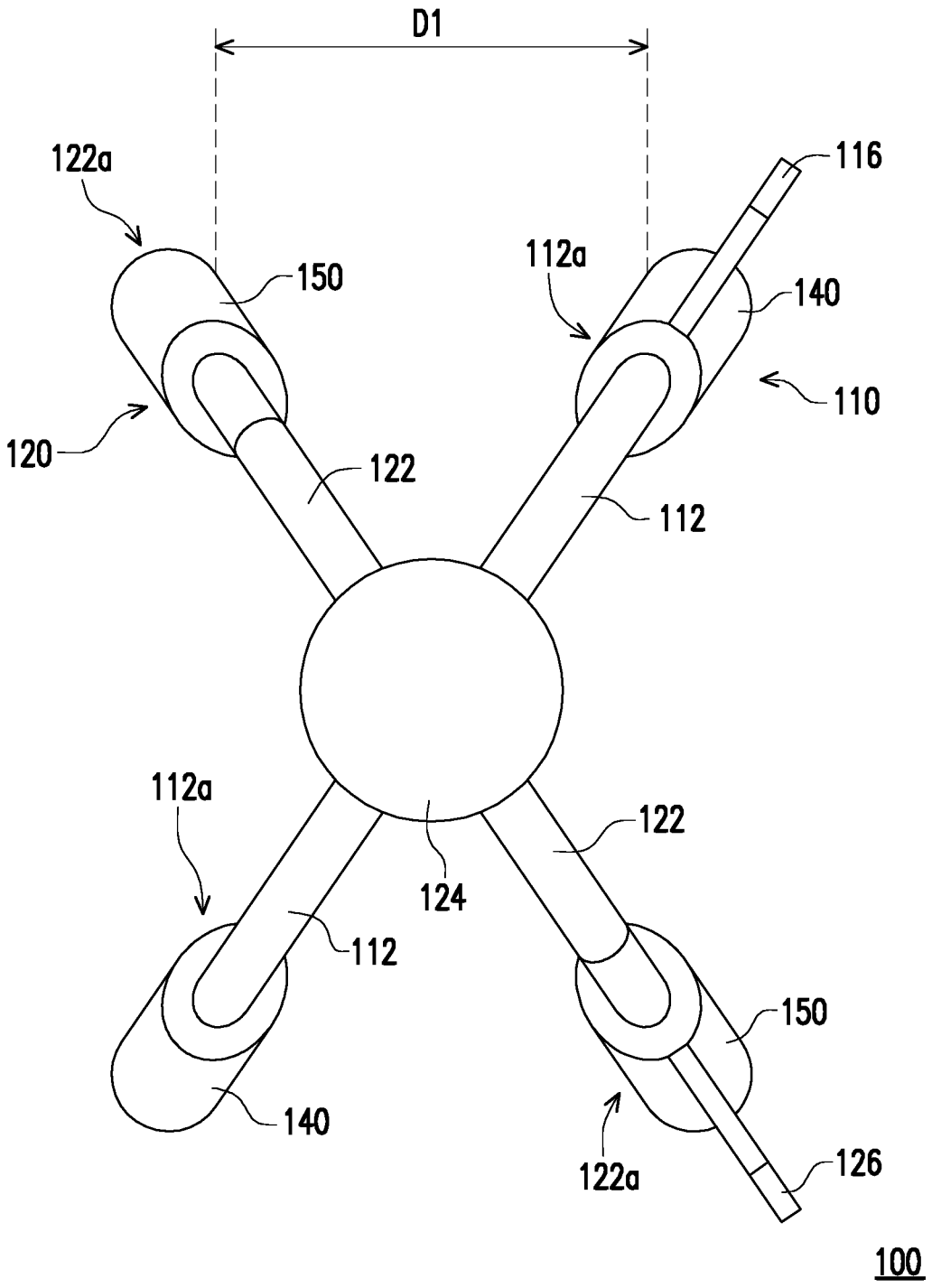
FIG. 2A and FIG. 2B illustrate relative rotation of a first clamping component and a second clamping component of FIG. 1 in different states.
Figure 2B:
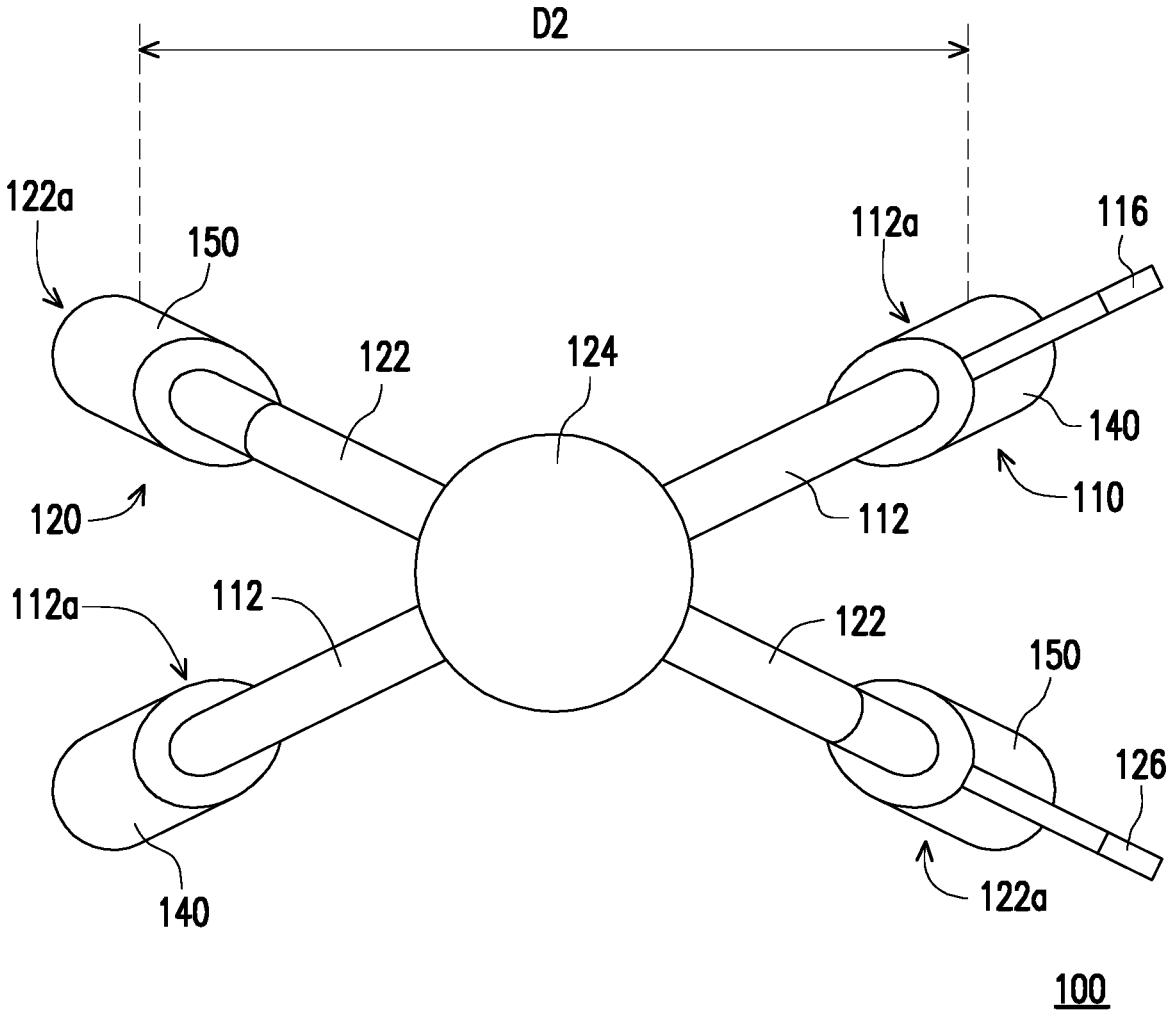

FIG. 2A and FIG. 2B illustrate the first clamping component and the second clamping component of FIG. 1 pivotally connected to the first pivot portions 114 through the second pivot portions 124 so as to rotate relative to each other to present a first state and a second state. Specifically, when a user does not apply a force to the first clamping component 110 and the second clamping component 120, the first clamping component 110 and the second clamping component 120 are in the first state as shown in FIG. 2A, and a first distance D1 is provided between the first clamping portion 112 and the second clamping portion 122. The first clamping component 110 and the second clamping component 120 are adapted to resist the elastic forces of the elastic components 130 thorough the force applied by the user, so as to rotate relative to each other from the first state shown in FIG. 2A to the second state shown in FIG. 2B. In this way, a second distance D2 greater than the first distance D1 is provided between the first clamping portion 112 and the second clamping portion 122. When the user no longer apply a force to the first clamping component 110 and the second clamping component 120, the first clamping component 110 and the second clamping component 120 are adapted to rotate relative to each other and to be restored from the second state shown in FIG. 2B to the first state shown in FIG. 2A through the elastic forces of the elastic components 130, and in this way, the first distance D1 is provided between the first clamping portion 112 and the second clamping portion 122.

Figure 3A:
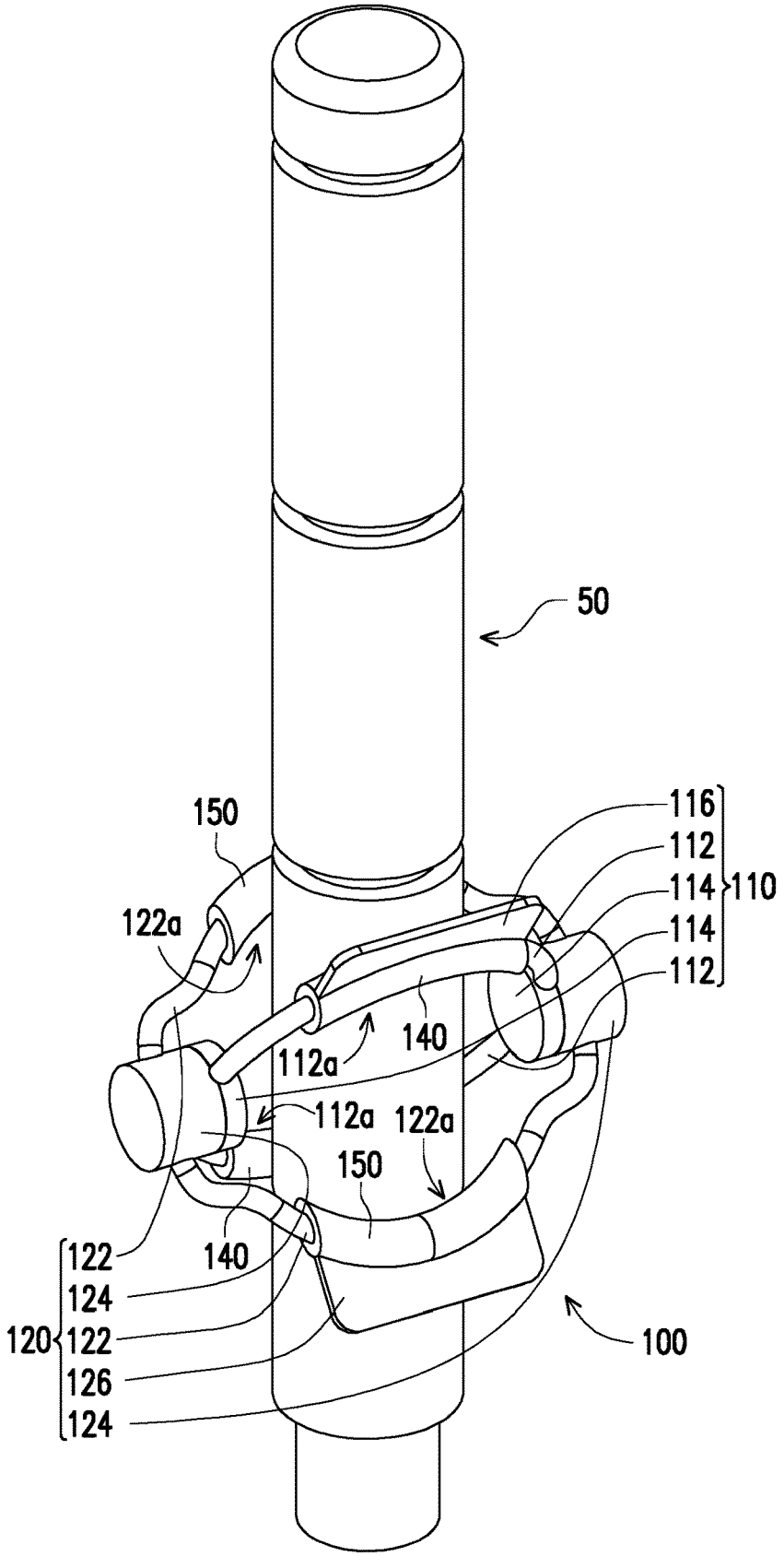
FIG. 3A and FIG. 3B illustrate the clamping device of FIG. 1 clamping an object.
Figure 3B:
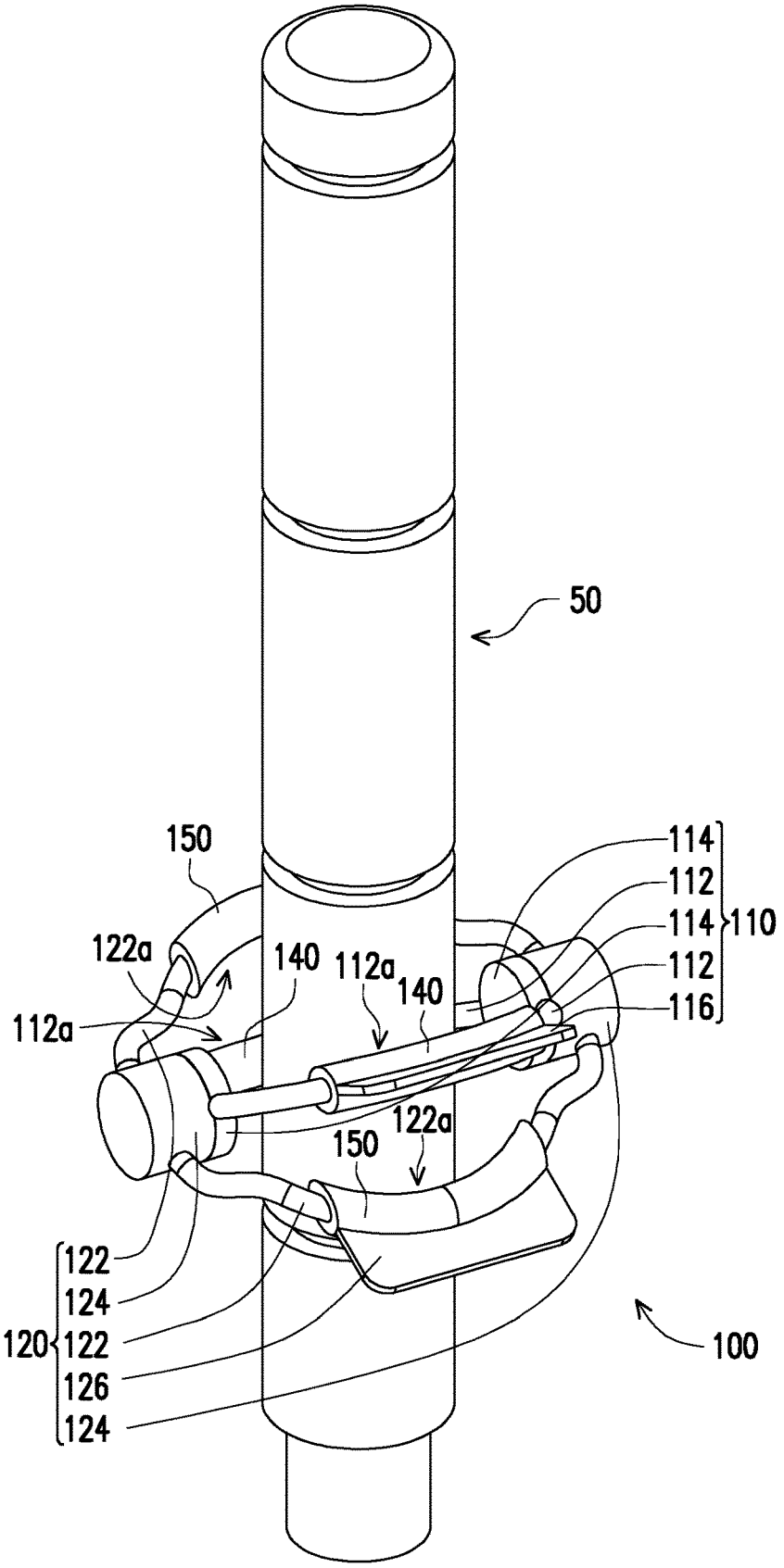

FIG. 3A and FIG. 3B illustrate the clamping device of FIG. 1 clamping an object. When the user intends to clamp a cylinder 50 shown in FIG. 3A and FIG. 3B by using the clamping device 100, the user may apply a force to the first clamping portion 112 and the second clamping portion 122 first, so as to resist the elastic forces of the elastic components 130 and to rotate the first clamping portion 112 and the second clamping portion 122 relative to each other to the second state shown in FIG. 2B respectively through the first pivot portion 114 and the second pivot portion 124. In this way, the second distance D2 greater than the first distance D1 is provided between the first clamping portion 112 and the second clamping portion 122, such that the cylinder 50 passes between the first clamping portion 112 and the second clamping portion 122 (as shown in FIG. 3B). Next, when the user no longer applies a force to the first clamping component 110 and the second clamping component 120, at this moment, the elastic components 130 provides the elastic forces when the first clamping component 110 and the second clamping component 120 are in the second state, so that the first clamping portion 112 and the second clamping portion 122 are restored to the first state as shown in FIG. 2A to be able to clamp the cylinder 50. In this way, the first distance D1 less than the second distance D2 is provided between the first clamping portion 112 and the second clamping portion 122, such that the cylinder 50 may be clamped between the first clamping portion 112 and the second clamping portion 122 as shown in FIG. 3A.

As described above, when the elastic components 130 are used to connect the first clamping component 110 and the second clamping component 120, and when clamping is performed by using the first clamping portion 112 connected between the two first pivot portions 114 and the second clamping portion 122 connected between the two second pivot portions 124, the cylinder 50 may be surrounded by the first clamping component 110 and the second clamping component 120 between the first pivot portions 114 and the second pivot portions 124 and thus is securely clamped.

Figure 4:
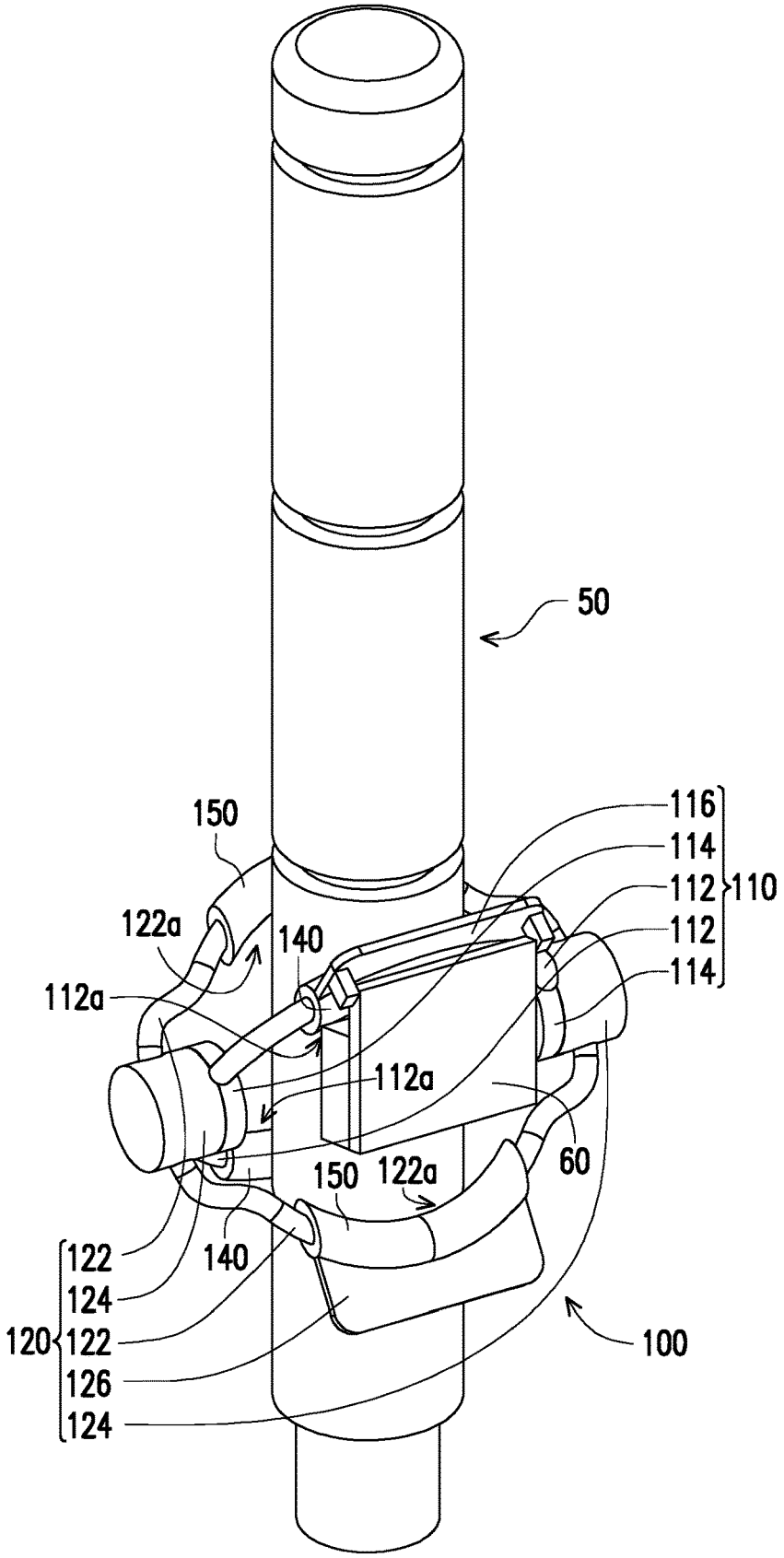
FIG. 4 illustrates installation of a light sensor on the clamping device of FIG. 3A.

FIG. 4 illustrates installation of a light sensor on the clamping device of FIG. 3A. For instance, the cylinder 50 is, for example, a warning light cylinder disposed on a computer numerical control (CNC) tool machine and is configured to emit a warning light when the tool machine operates abnormally. The user may install a light sensor 60 on the clamping device 100 through appropriate manners such as engaging and hanging. After the cylinder 50 is securely clamped by the clamping device 100 through the manner provided above, the warning light emitted by the cylinder 50 may be sensed through the light sensor 60. Moreover, a sensing signal is automatically transmitted to the CNC tool machine, such that the CNC tool machine may automatically stop operation of the tool machine or eliminates abnormalities.

As shown in FIG. 1, the first clamping portion 112 of this embodiment includes at least one first arc structure 112*a* (two are shown in this embodiment), and the second clamping portion 122 includes at least one second arc structure 122*a* (two are shown in this embodiment). Centers of curvature of the first arc structures 112*a* and the rotation axis A are located at a same side of the first arc structures 112*a*, and centers of curvature of the second arc structures 122*a* and the rotation axis A are located at a same side of the second arc structures 122*a*. That is, the concaved arcs of the first arc structures 112*a* and the second arc structures 122*a* face inwardly, so as to fit the cylindrical shape of the cylinder 50 and to perform clamping securely.

Figure 5A:
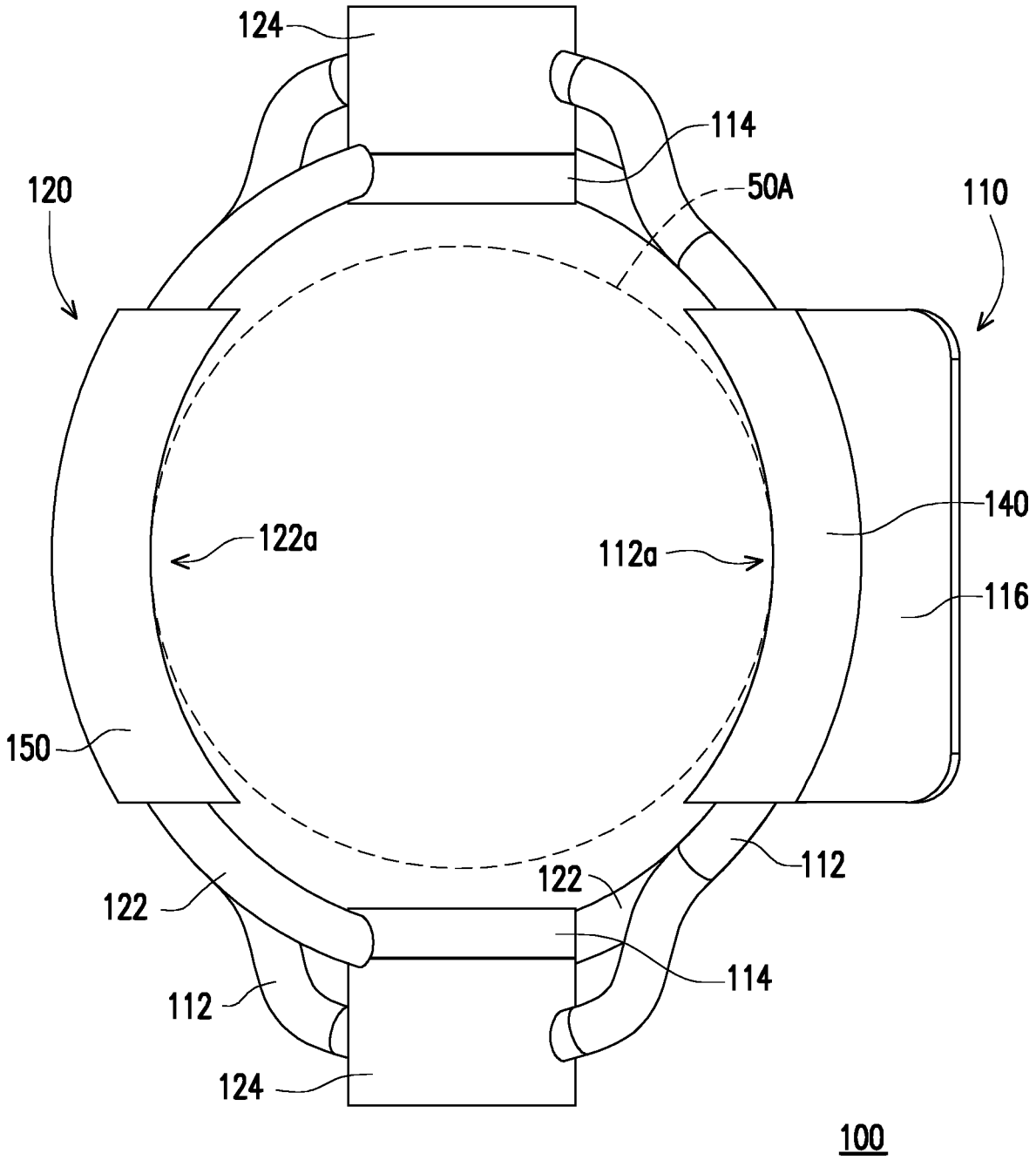
FIG. 5A and FIG. 5B illustrate the clamping device of FIG. 1 clamping cylinders of different sizes.
Figure 5B:
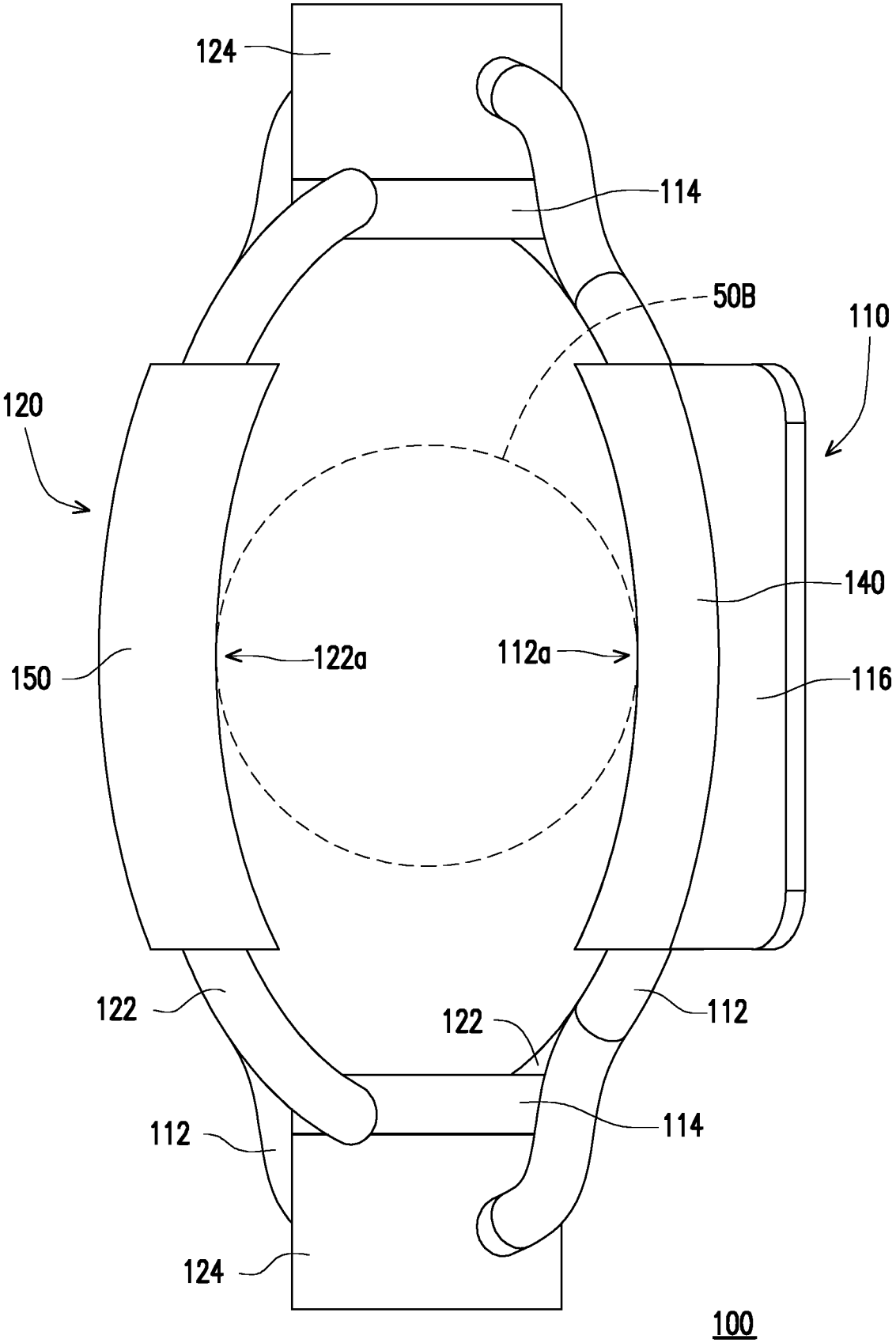

Further, through the first arc structures 112*a* of the first clamping portion 112 and the second arc structures 122*a* of the second clamping portion 122, the first clamping portion 112 and the second clamping portion 122 may be adapted to cylinders of different sizes. FIG. 5A and FIG. 5B illustrate the clamping device 100 of FIG. 1 clamping cylinders of different sizes. For instance, regardless of a cylinder 50A having a great outer diameter shown in FIG. 5A or a cylinder 50B having a less outer diameter shown in FIG. 5B, the clamping device 100 may clamp at least a portion of a circular arc surface of the cylinder through both the first arc structures 112*a* and the second arc structures 122*a*.

In this embodiment, the first clamping component 110 includes a first tongue piece 116, and the second clamping component 120 includes a second tongue piece 126. The first tongue piece 116 and the second tongue piece 126 are respectively located on the first clamping portion 112 and the second clamping portion 122 and are adapted to be applied by a force to drive the first clamping component 110 and the second clamping component 120 to rotate relative to each other to the second state shown in FIG. 2B and FIG. 3B. In other embodiments, the first clamping component 110 and the second clamping component 120 may facilitate force application performed by the user through other appropriate structure, which is not limited by the disclosure.

In addition, in this embodiment, the clamping device 100 may further include at least one first anti-skid component 140 (two are shown in this embodiment) and at least one second anti-skid component 150 (two are shown in this embodiment). The first anti-skid components 140 and the second anti-skid components 150 are respectively sleeved on the first arc structures 112*a* of the first clamping portion 112 and the second arc structures 122*a* of the second clamping portion 122. Further, the first anti-skid components 140 and the second anti-skid components 150 are configured to contact the object being clamped (such as the cylinder 50), so as to prevent relative sliding between the clamping device 100 and the object being clamped from generating. A material of the first anti-skid components 140 and the second anti-skid components 150 is, for example, rubber or other anti-skid materials, which is not limited by the disclosure.

In view of the foregoing, in the clamping device provided by the disclosure, the first clamping portion connected between the two first pivot portions and the second clamping portion connected between the two second pivot portions are used to clamp an object. In this way, the object (e.g., a cylinder) is surrounded by the first clamping component and the second clamping component between the pivot portions and thus is securely clamped.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A clamping device, comprising:

a first clamping component, comprising a first clamping portion and two first pivot portions, wherein the first clamping portion is connected to the two first pivot portions and comprises at least one first arc structure, and an accommodating space is between the two first pivot portions along a rotation axis;

a second clamping component, comprising a second clamping portion and two second pivot portions, wherein the second clamping portion is connected to the two second pivot portions and comprises at least one second arc structure, the two second pivot portions are respectively pivotally connected to the two first pivot portions, such that the first clamping component and the second clamping component are capable of rotating relative to each other to present a first state and a second state; and at least one elastic component, connected to the first clamping component and the second clamping component, wherein the at least one elastic component provides an elastic force when the first clamping component and the second clamping component are in the second state, such that the first clamping portion and the second clamping portion are restored to the first state to clamp an object located in the accommodating space, wherein each of the second pivot portions is pivotally connected to the corresponding first pivot portion along the rotation axis, a center of curvature of the at least one first arc structure and the rotation axis are located at a same side of the at least one first arc structure, and a center of curvature of the at least one second arc structure and the rotation axis are located at a same side of the at least one second arc structure.

2. The clamping device as claimed in claim 1, wherein each of the second pivot portions is pivotally connected to the corresponding first pivot portion along the rotation axis, and the first clamping portion and the second clamping portion are located between the two first pivot portions and are located between the two second pivot portions in a direction parallel to the rotation axis.

3. The clamping device as claimed in claim 1, wherein each of the second pivot portions is pivotally connected to the corresponding first pivot portion along the rotation axis, and the first clamping component intersects with the second clamping component in a direction parallel to the rotation axis.

4. The clamping device as claimed in claim 1, wherein a number of the at least one elastic component is two, one of the elastic components is connected between one of the first pivot portions and the corresponding second pivot portion, and the other one of the elastic components is connected between the other one of the first pivot portions and the corresponding second pivot portion.

5. The clamping device as claimed in claim 1, wherein the first clamping component comprises a first tongue piece, the second clamping component comprises a second tongue piece, and the first tongue piece and the second tongue piece are adapted to be applied by a force to drive the first clamping component and the second clamping component to rotate relative to each other to the second state.

6. The clamping device as claimed in claim 5, wherein the first tongue piece and the second tongue piece are respectively located on the first clamping portion and the second clamping portion.

7. The clamping device as claimed in claim 1, further comprising at least one first anti-skid component and at least one second anti-skid component, wherein the at least one first anti-skid component is sleeved on the first clamping portion, and the at least one second anti-skid component is sleeved on the second clamping portion.

* * * * *